US005418423A

United States Patent [19]

Murray

[11] Patent Number: 5,418,423

[45] Date of Patent: May 23, 1995

[54] CAPACITIVELY COUPLED TRIGGER FOR PSEUDOGAP COLD CATHODE THYRATRONS

[76] Inventor: Gordon A. Murray, 20306 Melville St., Orlando, Fla. 32833

[21] Appl. No.: 963,415

[22] Filed: Oct. 19, 1992

[51] Int. Cl.[6] ..... H01J 17/00

[52] U.S. Cl. ..... 313/589; 313/594; 313/595; 313/602; 313/618; 313/632; 315/330; 315/335; 361/120

[58] Field of Search ..... 313/589, 594, 595, 601, 313/602, 603, 607, 618, 631, 632; 315/169.1, 330, 336, 335; 361/120, 129; 307/108, 109

[56] References Cited

U.S. PATENT DOCUMENTS

| | | | |
|---|---|---|---|
| H60 | 5/1986 | Elkins et al. | 313/595 |
| 3,581,142 | 5/1971 | Boxman et al. | 315/330 |
| 3,706,898 | 12/1972 | Peterson | 315/330 |
| 3,989,973 | 11/1976 | Lange et al. | 361/120 |
| 4,631,453 | 12/1986 | deSouza et al. | 313/595 |
| 5,055,748 | 1/1991 | Reinhardt . | |
| 5,057,740 | 1/1991 | Kirkman-Amemiya . | |
| 5,143,460 | 10/1992 | Bovino et al. | 307/108 |

FOREIGN PATENT DOCUMENTS 2170949 8/1986 United Kingdom .

OTHER PUBLICATIONS

K. Frank and J. Christiansen The Fundamentals of the Pseudospark and it's applications IEEE Trans. on Plasma Science. vol. 17 No. 5, pp. 748-753 1989.

G. Mechtersheimer, R. Kohler, T. Lasser and R. Meyer High Repetition Rate, Fast Current Rise, Pseudo-spark Switch.: J. Phys. E Scientific Intruments, vol. 16, p. 317 Apr. 1988.

*Primary Examiner*—Donald J. Yusko

*Assistant Examiner*—N. D. Patel

[57] ABSTRACT

An improved gas discharge trigger for a pseudogap cold cathode thyratron. Electrical trigger pulses are capacitively coupled through the vacuum envelope wall (16) causing a gas discharge adjacent to the rear of the hollow cathode (26). Coupling apertures (12) between the trigger discharge region and the hollow cathode allow ionization to propagate into the rear of the hollow cathode and trigger the pseudogap from a non conducting to conducting state.

10 Claims, 3 Drawing Sheets

CAPACITIVELY COUPLED TRIGGER FOR PSEUDOGAP COLD CATHODE THYRATRONS

FIELD OF INVENTION

This invention relates to the pseudogap or pseudospark gap, a type of cold cathode thyratron. Pseudogaps are triggerable gas filled tubes capable of rapidly switching high voltages and high currents.

DESCRIPTION OF PRIOR ART

Many devices such as pulse charging system, lasers and radar require a fast, high voltage, high current, triggerable switch to generate fast electrical pulses. Such pulses are often switched by gas filled tubes such as spark gaps, thyratrons and pseudogaps.

Thyratrons and spark gaps are widely used in such applications and are both commercially available sealed off. Thyratrons are low pressure devices that operate in the glow discharge mode.

Generally thyratrons are of the heated thermionic cathode type and require many minutes to warm up. Because of the glow mode operation thyratrons exhibit long lifetime. Spark gaps operate in the constricted arc mode and generally have much shorter lifetimes. Spark gaps generally do not use thermionic cathodes and require no warm up period.

Thyratrons and spark gaps are often hard sealed devices. That is the seals can withstand a bakeout to at least 350 centigrade. The procedure for crating hard sealed long life devices requires that the vessels be baked out at high temperature, under vacuum to remove contaminants from the walls of the devices. This bakeout produces shelf lives of several years and sealed off operation. Hard sealed thyratrons and spark gaps have found many applications.

A pseudogap comprises a hollow anode electrode and hollow cathode electrode. The electrodes are separated by an insulator and contained within a vacuum tight envelope which is filled with low pressure gas. Some means of triggering the tube from the electrically non conducting to the electrically conducting state is required. Generally pseudogaps are capable of switching higher maximum currents and more rapid switching than conventional thyratrons.

Pseudogaps operate in the glow discharge mode at low gas pressure like conventional thyratrons. Pseudogaps combine some of the properties of thyratrons and spark gaps. Generally pseudogaps like spark gaps require no warm up time. Pseudogaps have been used to only a limited extent previously due to the difficulty in providing a simple triggering method and the lack of any sealed off, long life devices. Generally pseudogaps are coupled to a vacuum pump and a gas supply. Such an apparatus maintains a flow of low pressure gas through the pseudogap.

Previously described trigger systems for pseudogaps have utilized thermionic and photoemissive cathodes. These secondary cathodes provide free electrons in the region at the rear of the hollow cathode. The free electrons initiate ionization of the gas between the electrodes. The pseudogap then switches from an electrically non conducting to an electrically conducting state. After stored energy is dissipated the device returns to a non conducting state. In the case of the photoemissive cathode the free electrons are provided by applying ultraviolet radiation to the photoemissive material.

Additionally pseudogaps have been triggered by surface discharge triggers. A surface discharge trigger has limited lifetime. Moreover surface discharge triggers are not suited for high repetition rates.

Also multiple pulser arrangements which produce a gas discharge in the rear of the hollow cathode have been used as triggers. A gas discharge trigger system is bulky and requires critical timing of the various trigger and blocking pulses.

A cold cathode thyratron with instant on capability has been taught by Menown, UK Pat. No. 2170949A. However the device described requires additional internal control and intermediate grid electrodes other than the cathode and anode. Electrical pulses are delivered to these interval electrodes to initiate switching of the device. The device is not configured as a pseudogap.

Kirlanan, U.S. Pat. No. 5,057,740 has taught an instant on pseudogap thyratron or back lighted thyratron. In that case the switching action is triggered by an internal or external optical pulse from a light source or a laser, applied to the back of the hollow cathode region. The ultraviolet light generates electrons from a photoemissive cathode, separate and isolated from the main switch electrode. The need for an ultraviolet light source or laser makes this trigger method impractical in small systems.

Reinhardt, U.S. Pat. No. 5,055,748 has taught a method of triggering pseudogaps using a thermionic cathode separate and isolated from the main electrode to initiate triggering of the discharge. This entails the use of a delicate high temperature filament as with a conventional thyratron. Additionally, bulky external components are required to supply the filament heating current.

Because of the complex triggering arrangements, pseudogaps reported to date are not sealed off. The appropriate low gas pressure is maintained by a flowing source of gas and a vacuum pump. This severely limits pseudogap applications.

SUMMARY OF THE INVENTION

An object of the present invention is to provide a long life, high voltage, high current switching capability in an instant on device. Additionally the device is compact and simple to fabricate. Moreover the pseudogap is triggered by a directly applied electrical pulse and not indirectly through a lamp or laser.

A further object is to make the entire device simple to hard seal. This is more easily accomplished if the number of penetrations through the envelope wall is minimized. Hard sealing the device means that it will have a shelf life of several years. Also the device can be used without external support equipment such as a vacuum pump. Such support equipment presently makes the use of pseudogaps impractical in compact systems. The invention uses a lesser number of components than alternative discharge trigger methods.

Moreover unlike the trigger taught by Reinhardt, U.S. Pat. No. 5,057,740, the trigger described here does not require a heated element. Thus instant on operation is possible since no warm up period is required. Also the use of a delicate heated cathode limits high acceleration uses of the device. Additionally a heated cathode at approximately 1100 centigrade in a thyratron or pseudogap produces large mounts of waste heat that must be dissipated. Also the external circuitry required to drive a heated cathode can be omitted.

Additionally the invention provides a direct method for triggering pseudogap tubes without the need for complex multiple pulse electrical systems to produce a gas discharge in the rear of the hollow cathode. Moreover the capacitively coupled trigger is not limited in lifetime as is the surface discharge trigger. Also a capacitively coupled trigger operates well at high repetition rates.

Reference Numerals in Figures

| | |
|---|---|
| 10 is the tube connection | 12 are the cathode trigger region coupling apertures |
| 14 is the internal trigger electrode | 16 is the dielectric thin wall section |
| 18 is the intra electrode gap | 20 is the main body |
| 22 is the anode base | 24 is the hollow anode |
| 26 is the hollow cathode | 28 is the external trigger electrode |
| 30 is the trigger discharge space | 32 is the cathode base |
| 34 is the rear of the hollow cathode | 36 is the cathode central aperture |
| 38 is the anode central aperture | 40 is the rear of the hollow anode |
| 42 are trigger apertures | |

DESCRIPTION OF THE PREFERRED EMBODIMENT(S)

Figure 1:
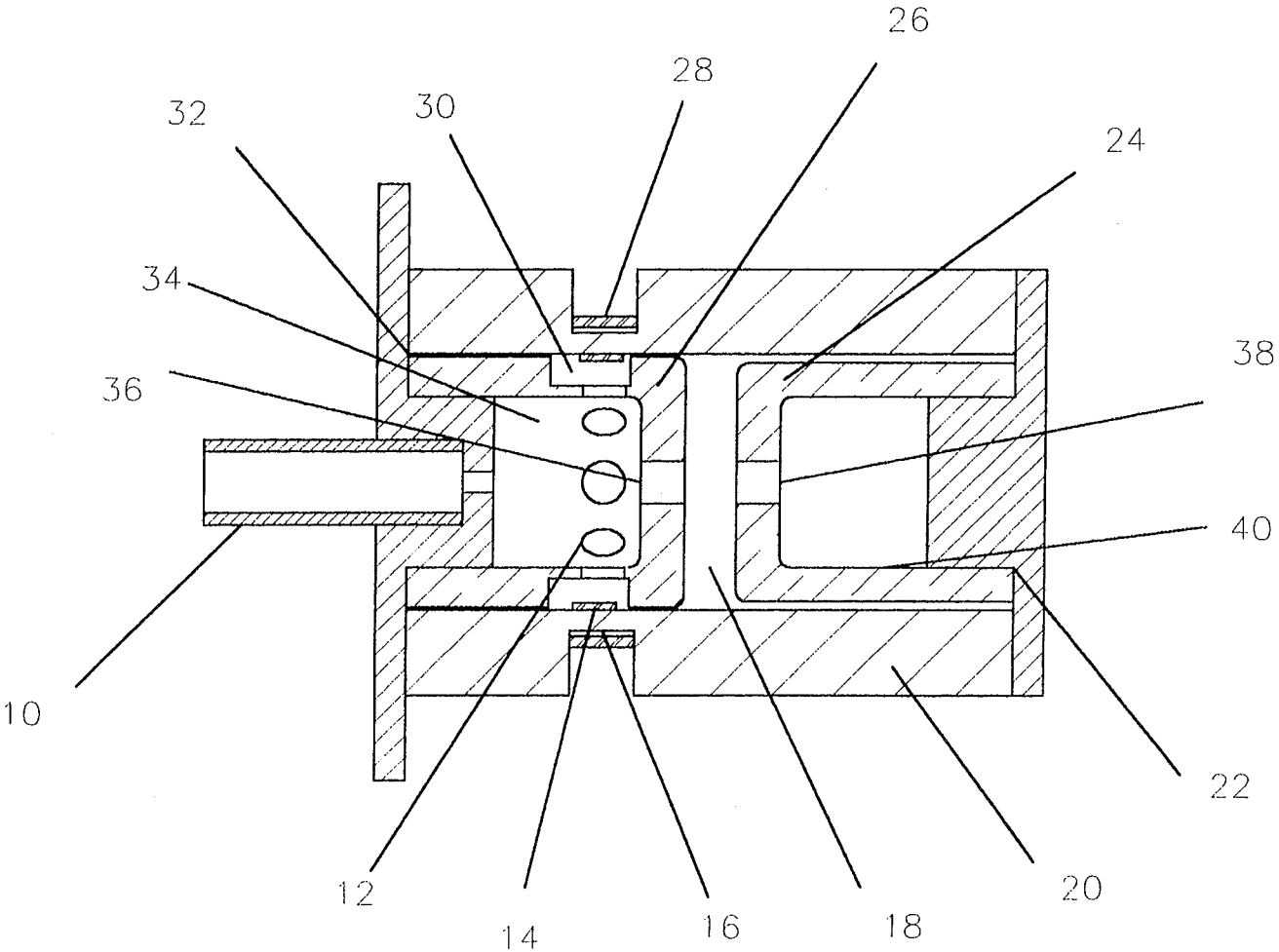
FIG. 1 is a sectional view of a cylindrical geometry, capacitively coupled trigger, pseudogap device according to an embodiment of the invention.
Figure 2:
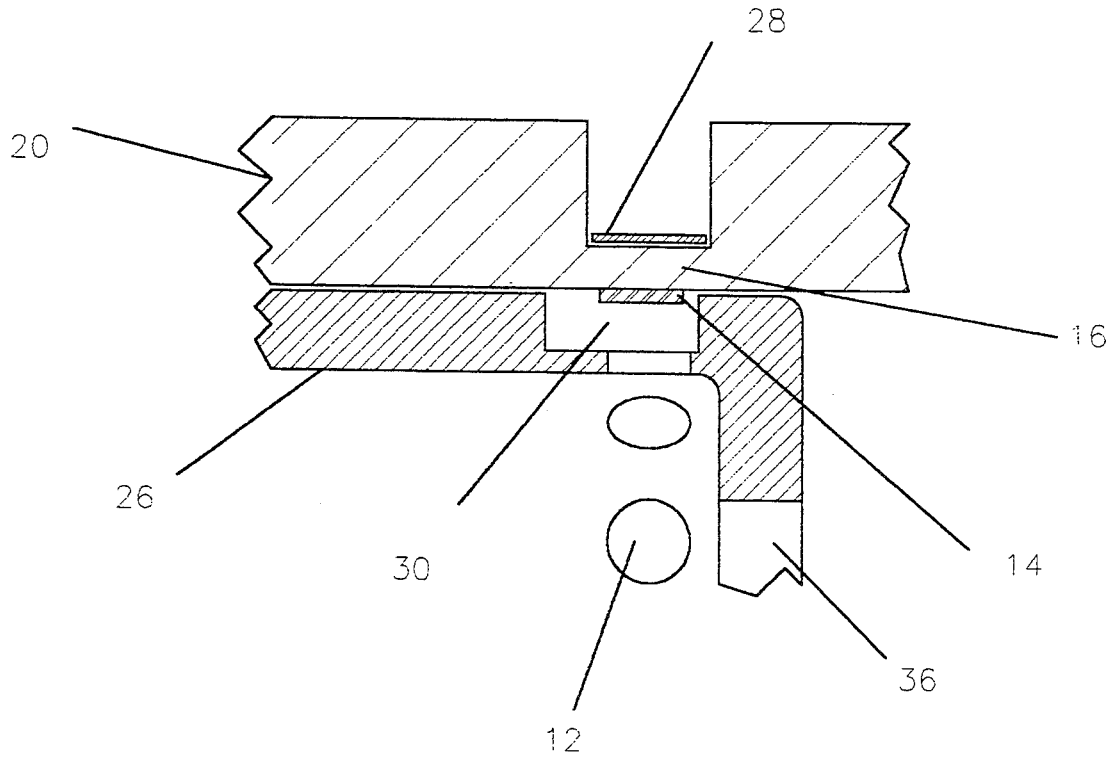
FIG. 2 is a detailed view of the trigger section of FIG. 1.

FIG. 1 shows a sectional view of a pseudogap according to the invention. The drawing shows a typical embodiment that is of cylindrical geometry. The scale of the device is a few inches. 20 is the main body, a vacuum tight insulating material that would typically be of ceramic or glass construction. Ceramic or glass is used in lieu of plastic so as to be bakeable. 22 is the anode base and 32 is the cathode base. These pain are sealed vacuum tight to 20 and are made from electrically conducting material. 24 is a hollow anode electrode attached to the anode base. 26 is a hollow cathode electrode attached to the cathode base. 28 is the external trigger electrode. The external trigger is an electrical conductor outside the vacuum envelope formed by the main body. Electrical pulses are applied to 28 to trigger the pseudogap. 14 is the internal trigger electrode. 16 in a thin section of the main body wall. This section acts as the dielectric in a capacitor when a pulse is applied to 28.30 is the trigger discharge region. Application of a pulse to 28 produces a gas discharge in this region. 12 are coupling apertures between region 30 and the rear of the hollow cathode. 10 is a tube sealed to the cathode base. 10 is used to pump out the pseudogap on a vacuum pump.

The invention consists of a gas filled vessel with anode and cathode electrodes separated by an insulator as shown in FIG. 1. In one mode of operation a positive voltage to be switched is applied to the anode section. Generally the cathode is maintained at ground potential, ,an electric field exists between the anode and the cathode. The pseudogap is initially non conducting and no current flows between anode and cathode. An electrical trigger pulse is applied to the external trigger electrode 28. The external electrode 28, the thin wall section 16 and the internal electrode 14 form a capacitor. The pulse capacitively couples to the internal trigger electrode 14. A voltage is produced on electrode 14. The hollow cathode is at ground potential and an electric field is generated between 14 and 26. Because of the low gas pressure, gas breakdown occurs between 14 and the ground surface furthest from 14. Again because of the low pressure the discharge is distributed and fills all of region 30. The gas discharge from region 30 also extends into the internal section of the hollow cathode 215, through the coupling apertures 12, between the trigger discharge region and the internal section of the hollow cathode. The electrons and ions from the trigger discharge are accelerated by the anode to cathode electric field. The electric field extends through the central aperture of the hollow cathode 36. The electrons are multiplied by avalanche ionization. Rapidly the gas fill in the region 18 transitions from the electrically non conducting to the conducting state. Current flows from the anode assembly 22 and 24 to the cathode assembly 28 and 32. The voltage on the anode is rapidly reduced to near ground potential.

The energy switched by the pseudogap is often stored in a capacitor electrically connected to the anode section. Once the stored energy is switched the ionization within the pseudogap clears and the device returns to a non conducting state. The cycle of triggering, switching and clearing may be maintained at high repetition rates.

Figure 3:
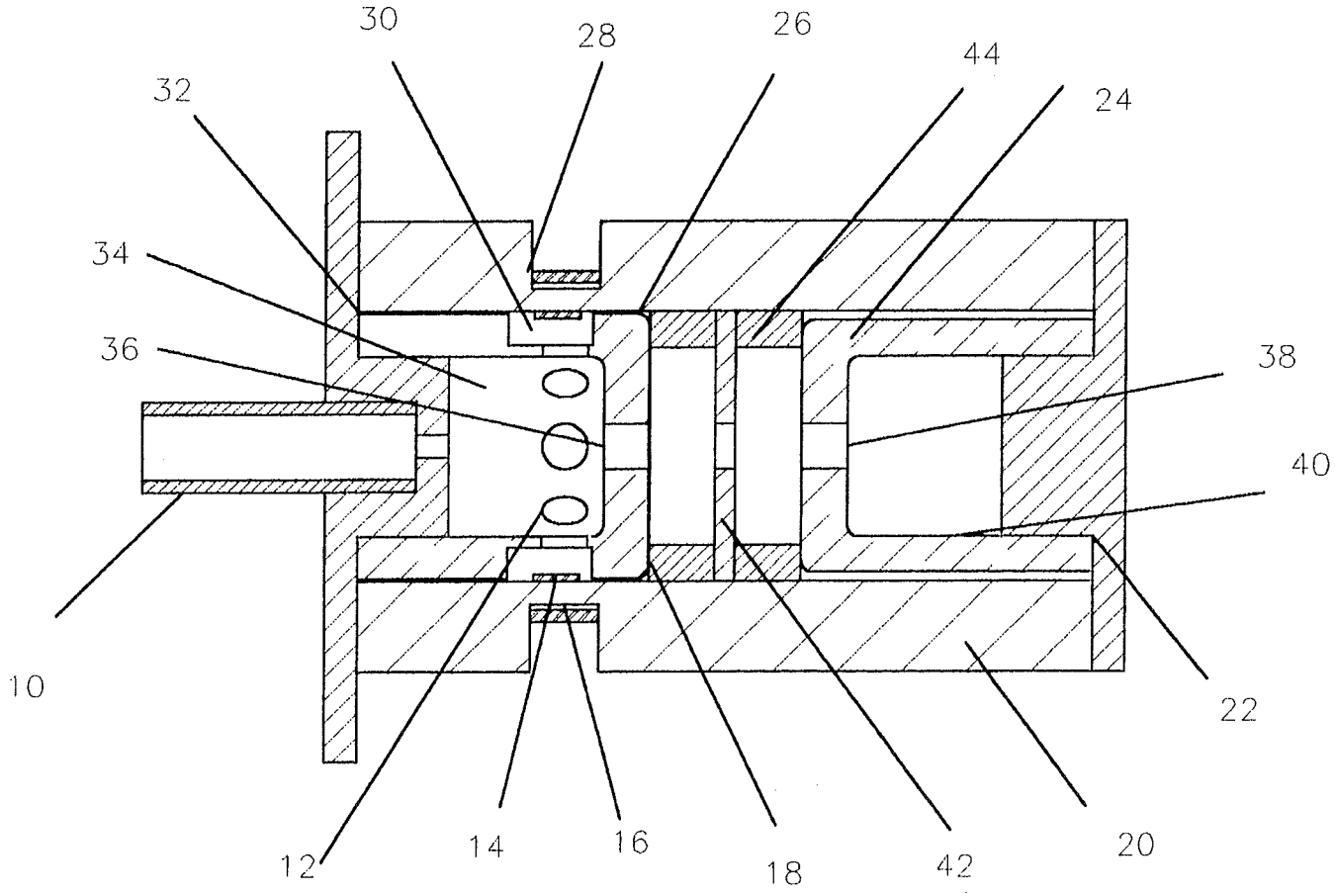
FIG. 3 is a sectional view of a capacitively coupled pseudogap device according to another embodiment of the invention.

Additional internal multiple plate electrodes with apertures, may be stacked between the single anode and cathode as shown in FIG. 3. The plates have central apertures coaxial with the anode and cathode apertures and are separated by insulators. The additional plate electrodes increase the maximum operating voltage.

A capacitively coupled discharge trigger is a novel feature for an instant on, hard sealed, bakeable, pseudogap. Such a pseudogap does not require a bulky optical trigger, a fragile thermionic emitter or a photoemissive material within the vacuum vessel. It also removes the need for additional external circuit components such as transformers, rheostats and rectifiers. The omission of a heated cathode removes a considerable heat load from the thyratron and allows operation at lower temperatures. Heat loads and cooling requirements are also reduced. This is a considerable advantage in lasers, microwave systems and radar. Also these devices can be switched on and off as needed rather than remaining in a ready mode.. The reduction in external circuitry will reduce weight.

The capacitively coupled trigger may also be used in conventional hot cathode thyratrons or spark gaps. Triggering would be obtained without the need for a conducting wall penetration.

Non cylindrical geometry configurations of a capacitively coupled triggered pseudogap may be constructed. For example the trigger can be applied to a linear geometry embodiment similar to a rail gap.

I claim:

1. A pseudogap electric switch comprising:

a gas filled vacuum tight vessel;

an anode attached to and extending into a first end of said vessel, said anode peripherally separated from the inner surface of the vessel by a first gap;

a cathode attached to and extending into a second end of said vessel, said cathode peripherally separated from the inner surface of the vessel by a second gap, said cathode having a cathode hole in a surface facing said anode;

an electrode gap between said anode and said cathode, said electrode gap being larger than said first gap and said second gap; and means for filling said vessel with a low pressure gas;

trigger means, comprising an external trigger electrode attached to the outer surface of said vessel and an internal trigger electrode attached to the inner surface of said vessel, said internal trigger electrode disposed adjacent the second end of said discharge vessel in such a manner that the distance between the internal trigger electrode and the anode is larger than said electrode gap, said internal trigger electrode and said external trigger electrode coupled capacitively to each-other and wherein the vessel is the capacitor dielectric of the capacitive coupling.

2. The pseudogap electric switch according to claim 1, wherein said anode comprises an anode hole in a surface facing said cathode, said anode hole being aligned with said cathode hole.

3. The pseudogap electric switch according to claim 1, wherein the cathode is hollow and comprises a cavity, said cathode hole extending into said cavity, said cathode further comprising at least one trigger aperture adjacent said internal trigger electrode, said at least one trigger aperture extending into said cavity.

4. The pseudogap electric switch according to claim 1, wherein at least one electrode is disposed between said anode and said cathode, said at least one electrode having a hole aligned with said cathode hole.

5. The gas filled vacuum tight vessel configured as a pseudogap electric switch according to claim 1, wherein the portion of said vessel through which said external trigger electrode and said internal trigger electrode are capacitively coupled to each other is thinner than remainder of said vessel and has a thickness of about 0.020 inch to about 0.070 inch.

6. A pseudogap electric switch comprising:

a gas filled vacuum tight vessel;

an anode attached to and extending into a first end of said vessel, said anode circumferentially separated from the inner surface of the vessel by a first gap;

a cathode attached to and extending into a second end of said vessel, said cathode circumferentially separated from the inner surface of the vessel by a second gap, said cathode having a cathode hole in a surface facing said anode, the cathode being hollow and comprising a cathode cavity, said cathode hole extending into said cathode cavity, said cathode further comprising at least one trigger aperture between said cathode hole and said second end of said vessel;

an electrode gap between said anode and said cathode, said electrode gap being larger than said first gap and said second gap;

trigger means, comprising an external trigger electrode attached to the outer surface of said vessel and an internal trigger electrode attached to the inner surface of said vessel, said internal trigger electrode disposed adjacent said at least one trigger aperture, said internal trigger electrode and said external trigger electrode coupled capacitively to each-other and wherein the vessel is the capacitor dielectric of the capacitive coupling.

7. The pseudogap electric switch according to claim 6, wherein said anode is hollow and comprises an anode cavity, the anode further comprises an anode hole in a surface facing said cathode, said anode hole extending into said anode cavity and aligned with said cathode hole.

8. The pseudogap electric switch according to claim 6, wherein said at least one trigger aperture is separated from the inner surface of the vessel by a distance greater than said second gap.

9. The pseudogap electric switch according to claim 6, wherein at least one electrode is disposed between said anode and said cathode, said at least one electrode having a hole aligned with said cathode hole.

10. The pseudogap electric switch according to claim 6, wherein the portion of said vessel through which said external trigger electrode and said inner trigger electrode are capacitively coupled to each other is thinner than remainder of said vessel and has a thickness of about 0.020 inch to about 0.070 inch.

* * * * *